US007243914B2

(12) United States Patent
Tokunaga et al.

(10) Patent No.: US 7,243,914 B2
(45) Date of Patent: Jul. 17, 2007

(54) PAPER GATHERING AND FEEDING METHOD AND DEVICE THEREFOR, AND ROTATION MEMBER

(75) Inventors: Daisuke Tokunaga, Otsu (JP); Hideyuki Sawayama, Omihachiman (JP)

(73) Assignee: Omron Corporation, Kyoto-fu (JP)

( * ) Notice: Subject to any disclaimer, the term of this patent is extended or adjusted under 35 U.S.C. 154(b) by 0 days.

(21) Appl. No.: 10/685,786

(22) Filed: Oct. 16, 2003

(65) Prior Publication Data

US 2004/0135304 A1 Jul. 15, 2004

(30) Foreign Application Priority Data

Oct. 16, 2002 (JP) ..... 2002-302009

(51) Int. Cl.
*B65H 85/00* (2006.01)

(52) U.S. Cl. ..... 271/3.01; 271/314

(58) Field of Classification Search ..... 271/3.01, 271/3.08, 4.07, 4.1, 10.08, 10.11, 34, 178, 271/314, 220, 110
See application file for complete search history.

(56) References Cited

U.S. PATENT DOCUMENTS 3,166,313 A * 1/1965 Rehm ..... 271/178
4,753,431 A * 6/1988 Fujimoto et al. ..... 271/3.08
4,925,173 A * 5/1990 Lindblom et al. ..... 270/52.14
5,348,281 A * 9/1994 Yamada et al. ..... 271/3.01
5,415,390 A * 5/1995 Guerrero ..... 271/215

(Continued)

FOREIGN PATENT DOCUMENTS

EP 0994445 4/2000

(Continued)

OTHER PUBLICATIONS

English translation of the claim of Japanese Publication No. 61-2641 from PTO/Translations.*

*Primary Examiner*—Patrick Mackey
*Assistant Examiner*—Thomas Morrison
(74) *Attorney, Agent, or Firm*—Dickstein Shapiro LLP

(57) ABSTRACT

Proposed is a paper gathering and feeding method, a device therefor, and a rotation member acting sufficiently also on any deformed notes at the time of gathering, and at the time of feeding, feeding is not prevented irrespective of the plasticity deformation, and an object thereof is to reduce the exchange frequency and maintenance of the rotation member, extend the continuous operation time of the paper gathering and feeding device, and realize comprehensive reduction of production cost, service cost, and the like. With respect to a paper gathering and feeding method or a device therefor performing a gathering process for dropping paper to be transferred in a transfer section to gather the same in a gathering section, and a feeding process for feeding the paper gathered in the gathering section to the transfer section, a rotation member provided with a changeable piece changeable with a radius distance between a tip section and a rotation axis is provided in the vicinity of a coupling section between the transfer section and the gathering section, and at the time of the gathering process, the rotation member is so formed as to rotate in a gathering direction to slap down the paper using the changeable piece with the wider radius distance, and at the time of the feeding process, the rotation member rotates in a feeding direction to perform the feeding allowance operation to allow the paper to be fed.

17 Claims, 11 Drawing Sheets

U.S. PATENT DOCUMENTS

| | | | | | |
|---|---|---|---|---|---|
| 5,553,840 | A | * | 9/1996 | Arikawa | 271/3.08 |
| 5,775,682 | A | * | 7/1998 | Hosking et al. | 271/3.08 |
| 5,899,448 | A | * | 5/1999 | Hosking | 271/3.01 |
| 6,331,000 | B1 | * | 12/2001 | Beskitt et al. | 271/3.08 |
| 2003/0160380 | A1 | * | 8/2003 | Choi et al. | 271/109 |

FOREIGN PATENT DOCUMENTS

| | | | |
|---|---|---|---|
| JP | 61-2641 | * | 1/1986 |
| JP | 61-41159 | | 3/1986 |
| JP | 63-208466 | | 8/1988 |
| JP | 1-252458 | * | 10/1989 |
| JP | 2001-354349 | | 12/2001 |
| JP | 2003 171068 | | 10/2003 |
| JP | 2004-010346 | | 1/2004 |

* cited by examiner

PRIOR ART

PRIOR ART

PAPER GATHERING AND FEEDING METHOD AND DEVICE THEREFOR, AND ROTATION MEMBER

BACKGROUND OF THE INVENTION

1. Field of the Invention

The present invention relates to a paper gathering and feeding method and a device therefor, and a rotation member for performing, with respect to paper, a gathering process and a feeding process in such a manner as gathering notes from a transfer path to a gathering section in the gathering process such as a credit transaction, and feeding the notes from the gathering section to the transfer path in the feeding process such as a debit transaction.

2. Description of Related Art

Conventionally, a note gathering and feeding device for gathering and feeding notes of required amount by ATM, for example, a note gathering and feeding device 1' as shown in FIGS. 10 and 11, has been proposed, in which an impeller 91 made of a rubber material is provided in the vicinity of a gathering port for transferring the notes and transferring those to a gathering section. The impeller works during the gathering process and is retracted during a feeding process. (An exemplary device is described in Japanese Patent Application No. JP-A-2001-368334, which is herein incorporated by reference.

The structure and the operation of the note gathering and feeding device 1' are roughly described by referring to right side cross sectional views shown in FIGS. 10 and 11.

During the gathering operation in which the note gathering and feeding device 1' collects notes 2, as shown in FIG. 10, a feed roller 31 is rotated in a gathering direction (in a counterclockwise direction in the drawing), and by the rotation force produced by the rotation, the notes 2 are transferred over a transfer path 51. At this time, the impeller 91 is rotating in the gathering direction (in a clockwise direction in the drawing). The centrifugal force produced by the rotation causes the blades 91*a* to spread out as shown in FIG. 10. Therefore, once the notes 2, having transferred over the transfer path 51, are transferred to a gathering space 3, the blades 91*a* slap down the notes 2, and the notes 2 are thus smoothly accumulated on an up-and-down board 11 in a horizontal manner.

As shown in FIG. 11, during the feeding operation in which the note gathering and feeding device 1' feeds the notes 2, a pickup rotation body 61 is so controlled as to be in the condition pivotally movable in the downward direction, and rotated in a feeding direction (in a counterclockwise direction in the drawing) to feed the notes 2 out to the transfer path 51. At this time, the impeller 91 is stopped without rotating, and the blades 91*a* thereof are in a retracted position. Thus, the blades 91*a* do not prevent the notes 2 from being fed and transferred at the time of transferring the notes 2 over the transfer path 51 by the rotation force of the feed roller 31 rotating in the feed direction (in a clockwise direction in the drawing).

In such a manner, the note gathering and feeding device 1' has no mechanism for controlling, in the vertical direction, the movement of the impeller itself which has been required in the conventional type including an impeller made of a plastic film, aiming at cutting cost down.

The problem here is that, with the note gathering and feeding device 1' such as ATM frequently performing the gathering process and the feeding process, resultantly the impeller 91 is heavily used. With continuous use, the rubber material is deformed in terms of plasticity, and with still continuous use for longer days, the blades 91*a* may spread wide open even if they are not in operation. As a result, the blades 91*a* may hit the notes 2 coming from the transfer path 51, causing paper clogging.

Further, the blades 91*a* are each curved in such a manner that the intermediate section between the tip section and the base section on the side of the rotation axis comes first at the time of gathering. This makes the contact angle obtuse between the note 2 and the blades 91*a* when the note 2 is slapped down, failing in acting sufficiently on the notes 2 if those are deformed, e.g., crimped (hereinafter referred to as deformed notes).

SUMMARY OF THE INVENTION

In consideration of the above problems, the present invention relates to a note gathering and feeding method, a device therefor, and a rotation member acting sufficiently on both deformed and non-deformed notes at the time of gathering, and at the time of feeding, not preventing feeding no matter if plasticity deformation is occurring. An object of the present invention is to reduce the exchange frequency and maintenance of the rotation member, thus extending the continuous operation time of the paper gathering and feeding device, and realizing a significant reduction in production costs, service costs, and the like.

Specifically, the present invention is directed to a paper gathering and feeding method and a device for performing a gathering process for dropping paper to be transferred in a transfer section, to gather the same in a gathering section, and a feeding process for feeding the paper gathered in the gathering section to the transfer section. The paper gathering and feeding method and device are characterized by a rotation member provided with a changeable piece changeable with a radius distance between a tip section and a rotation axis in the vicinity of a coupling section between the transfer section and the gathering section, and at the time of the gathering process, the rotation member rotates in a gathering direction to slap down the paper using the changeable piece with the wider radius distance, and at the time of the feeding process, the rotation member rotates in a feeding direction to perform the feeding allowance operation allowing the paper to be fed.

The paper includes those structured by notes, cards, paper, and printed paper.

The changeable piece includes those formed by a deformable resin member exemplified by a rubber material, a deformable metal member exemplified by a deformable elastic sheet iron, a deformable structure body bendable or curvable in the rotation direction by pivotally moving at the base section on the side of the rotation axis or/and the intermediate section between the base section and the tip section, or an extendable material extendable in the radius direction of the rotation axis.

Further, the changeable piece includes those formed by a curtain body of a predetermined width, thickness, and length, or a string body of a predetermined thickness. If it is a curtain body, included are those formed to be any fixed shape invariant in width, thickness, and length, taper shape increasing in thickness towards the tip side, taper shape increasing in width toward the tip side, and gravity-forward shape including weights at the tip side. Similarly, if it is a string body, included are those formed to be fixed shape invariant in thickness, taper shape increasing in thickness towards the tip, and gravity-forward shape including weights at the tip side.

The tip section denotes the tip part outside of the changeable piece.

The rotation member includes those formed by a piece-existent roller (or blade-existent roller) including one or more of the changeable piece, or a piece-existent rotation axis (or a blade-existent rotation axis) including one or more of the changeable piece.

The rotation axis includes those formed by a rotation axis or a part of the rotation member to which the rotation member is inserted or attached using adhesives.

The slapping movement includes those set to the operation of slapping the paper at the tip part and/or the intermediate section of the changeable piece.

The feeding allowance operation includes those set to the operation of rotating the rotation member in the feeding direction with the same speed as the feeding speed so as not to prevent feeding due to the changeable piece touching the paper, or so as to assist feeding through touching.

Note here that, the expressions of rotation in the gathering direction and rotation in the feeding direction denote, respectively, rotation in a clockwise direction at the time of gathering (gathering direction), and rotation in a counter-clockwise direction at the time of feeding (feeding direction) in a case where, for example viewed from the right side, the gathering section is located on the right side, to the upper left thereof, located is the transfer section, and to the lower left of the connection section between the transfer section and the gathering section, placed is the rotation member.

As a preferred embodiment, the changeable piece may be formed in a curve shape curving in the rotation backward direction (backward with respect to the rotation direction) when the intermediate section between the tip section and the base section on the side of the rotation axis is in the slapping operation.

The curve shape includes a full circle, a distorted circle varying in curving angle at any predetermined positions such as the tip section, the intermediate section, and the base section, or a bend shape bending at one or more positions to be possibly regarded as curved in its entirety.

Further, the present invention can be directed to a rotation member including a changeable piece variable with the radius distance between the tip section and the rotation axis to be used with the paper gathering and feeding method or the paper gathering and feeding device of the above type.

Thus, the present invention provides a high-capability paper gathering and feeding device, which is capable of preventing clogging in the gathering process and the feeding process, and achieving smooth gathering and feeding. Moreover, the present invention reduces maintenance costs by extending the uptime of the rotation member.

DESCRIPTION OF PREFERRED EMBODIMENTS

One exemplary embodiment of the present invention is described below with reference to the accompanying drawings.

Figure 1:
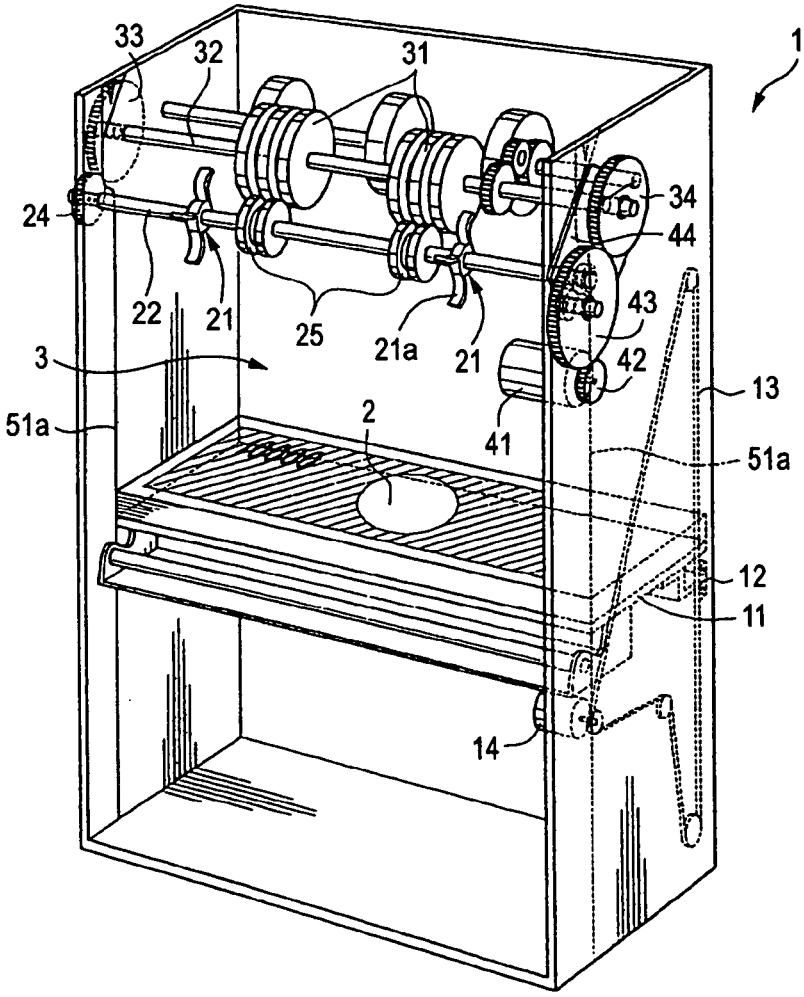
FIG. 1 shows a perspective view showing the outer appearance of a paper gathering and feeding device.

Referring to FIG. 1 showing a perspective view of a paper gathering and feeding device 1, the outward appearance and the structure of the paper gathering and feeding device 1 are described.

The paper gathering and feeding device 1 is so shaped as to outwardly look like a box, while internally the device 1 houses a gathering space 3 for accumulating the notes 2 in a horizontal manner, and at the bottom of the gathering space 3, located is the up-and-down board 11 having the size of a note (size of about a note).

The up-and-down board 11 is so guided as to vertically move along the side wall, while remaining in a horizontal position with respect to the side walls. To the up-and-down board 11, an up-and-down belt 13 is partially fixed using an adhesive section 12. The up-and-down belt 13 is rotated forward or reverse responding to the forward or reverse rotation control of a forward-reverse rotation motor (pulse motor) 14 by arbitrary control means, controlling the vertical motion of the up-and-down board 11.

To the upper part of the paper gathering and feeding device 1, a feed axis 32 is provided in the lateral direction for bearing. Two substantially cylindrical feed rollers 31 are attached to the axis 32 by insertion at predetermined intervals. The feed rollers 31 transfer the notes 2 to the deep recess at the time of gathering, and upward at the time of feeding.

To one end of the feed axis 32 (upper right end in the drawing), a gear 34 is securely attached by insertion. Via the gear 43 and another gear 42 attached to the forward-reverse rotation motor 41, which acts as the driving force for the forward and reverse rotation of the above-referenced gears 34, 42, 43 and the axis 32. Herein, the forward-reverse rotation motor 41 is forward-reverse-rotation controlled by arbitrary control means.

To the other end of the feed axis 32 (upper left end in the drawing), a gear 33 is attached by insertion. Via a gear 24, the driving force is transferred to a shaft 22 provided front below the feed axis 32 for bearing.

To the shaft 22, two gate rollers 25 are provided in position opposing to the feed rollers 31, respectively, and the peripheral surface thereof is formed with a convex surface to slightly fit into a groove formed to the feed rollers 31, whereby the feed roller 31 and the gate roller 25 overlap each other. Here, the gate roller 25 is so structured as to rotate in the gathering direction at the time of gathering, and at the time of feeding, to stop without rotating.

The gate rollers 25 are outwardly provided with centrifugal impellers 21, respectively, for slapping down the notes at the time of gathering. Thus, the shaft 22 functions as the axis of the centrifugal impeller 21.

As to the centrifugal impeller 21, as will be described later, the blades 21*a* are retracted when the impeller 21 is not rotating. The impeller blades 21*a* are formed from any arbitrary rubber material in such a manner that the blades 21*a* spread by the centrifugal force produced by rotation of the impeller 21 (rotation operation).

The centrifugal impeller 21 is so structured as to rotate in the gathering direction at the time of gathering and in the feeding direction at the time of feeding. Such a structure will be described later in detail.

Herein, the centrifugal impellers 21, the shaft 22, and the gate rollers 25 form a gathering and feeding auxiliary device 20 (described later).

One end of the shaft 22 (upper right in the drawing) is positioned, for bearing, to a positioning board 44 outside of the gathering space 3, and together with the feed axis 32 similarly positioned to the positioning board 44 for bearing, the end part (upper right in the drawing) is positioned.

Such a structure allows the notes 2 to be transferred by the transfer force by the feed rollers 31 and the gate rollers 25, and the notes 2 to be accumulated in the gathering space 3 at the time of gathering, and at the time of feeding, the notes 2 to be fed from the transfer path. During this gathering/feeding operation, the centrifugal impellers 21 also act as operation assistance.

Figure 2:
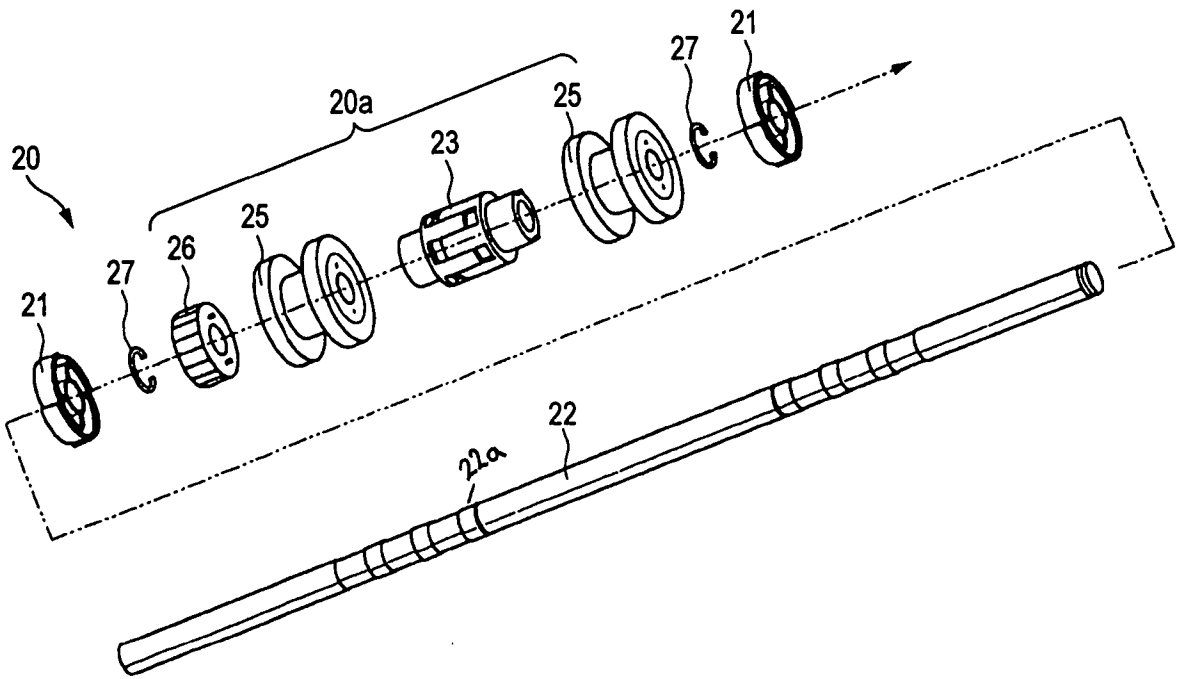
FIG. 2 shows an exploded perspective view showing the structure of the paper gathering and feeding auxiliary device.

Next, referring to FIG. 2 for an exploded perspective view of the gathering and feeding auxiliary device 20, the structure of the gathering and feeding auxiliary device 20 is described.

The gathering and feeding auxiliary device 20 performs insertion to the shaft 22 made of a metal material in such a manner that a coupling section 23 in the middle, the gate rollers 25 located on both sides thereof, and a gear 26 outside the gate roller 25 on the left side all rotate as a single unit. In such a manner as to sandwich both sides of the gate section 20*a* formed by the coupling section 23, the gate rollers 25, and the gear 26, an E ring 27, such as a washer cleat, is engaged into a clear groove 22*a* of the shaft 22, thereby positioning the gate section 20*a*.

On the outside part of the gate section 20*a* of the shaft 22, the centrifugal impellers 21 are attached by insertion.

Figure 3:
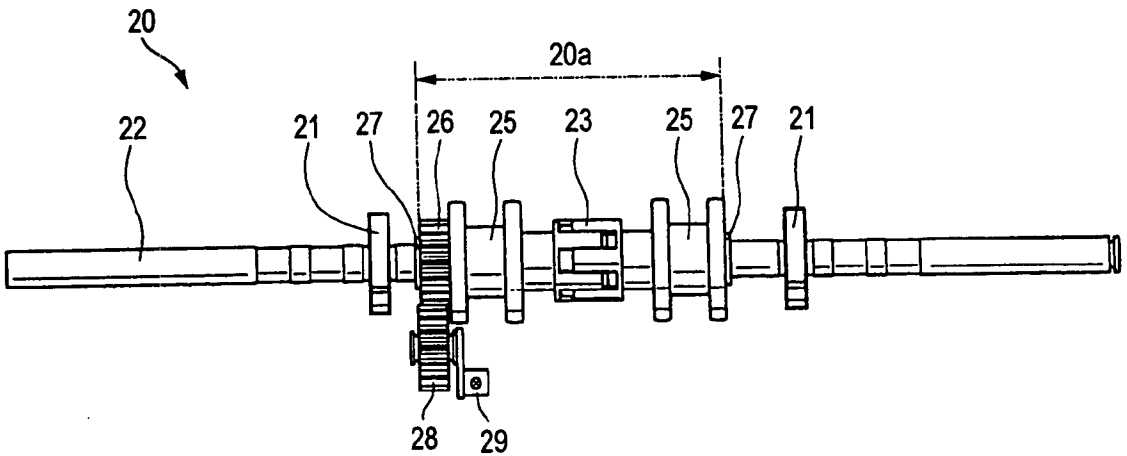
FIG. 3 shows a front view of the paper gathering and feeding auxiliary device.
Figure 4:
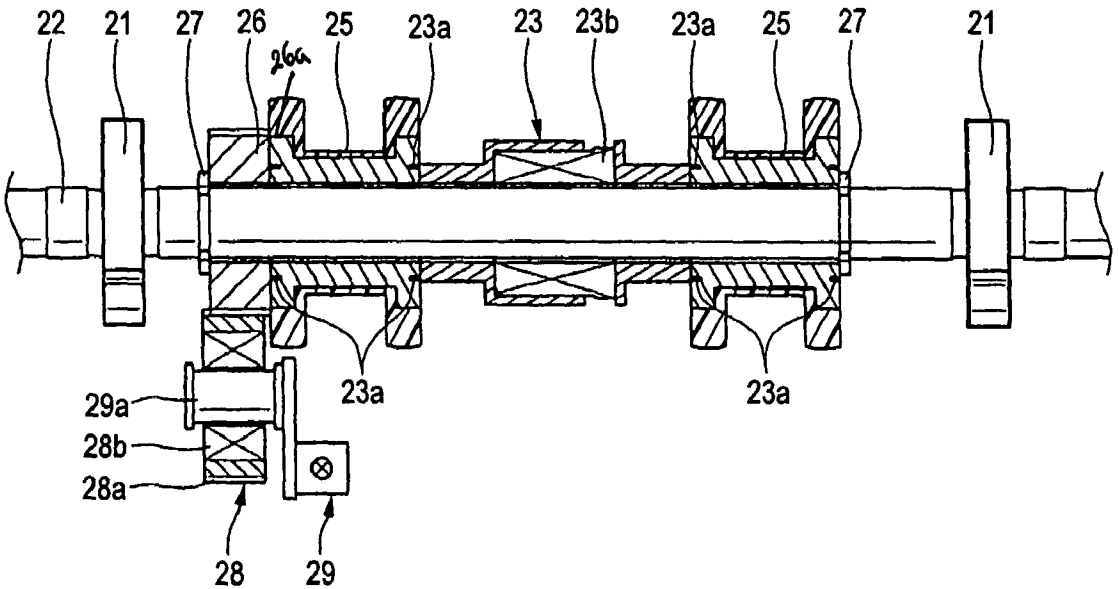
FIG. 4 shows a front cross sectional view of a part of the paper gathering and feeding auxiliary device.

Referring now to FIGS. 3 and 4, the gathering and feeding auxiliary device 20 assembly is so structured that the gate section 20*a* operates as a a single unit.

In more detail, the side plane of the gate roller 25 is provided with an engagement hole (concave section) as shown in FIG. 4, and the engagement hole is engaged with engagement boss sections 23*a* and 26*a* provided to the side plane of the coupling section 23 and that of the gear 26, respectively, for coupling. With such a structure, thus coupled components are not allowed to independently rotate but rotate/not rotate as the gate section 20*a* as an individual piece.

The coupling section 23 comprises a one-way clutch 23*b*, which does not rotate with respect to the shaft 22 in the gathering direction (i.e. the clutch 23*b* rotates as a piece with the shaft 22), while in the feeding direction, the clutch 23*b* becomes free with respect to the shaft 22.

To the gear 26, a one-way gear 28 is connected at the lower position. To the one-way gear 28, rotation is transferred by a gear 28*a* formed to the peripheral surface thereof engaging with the gear 26, and a one-way clutch 28*b* accommodated inside stops the rotation in the feeding direction, and in the gathering direction, the orientation of the clutch is so set as to accept rotation, thereby bearing is done to a fix axis 29*a* of a fixation section 29. Here, the fixation section 29 is securely attached to a guide board 52 (described below) of the transfer path.

With such a structure, the one-way gear 28 allows the gate rollers 25 to rotate in the gathering direction, but not in the feeding direction.

As a result, in the gathering and feeding auxiliary device 20, every component rotates by the shaft 22 at the time of gathering, and at the time of feeding, the centrifugal impellers 21 and the shaft 22 rotate but the gate section 20*a* does not rotate.

With the above structure, the gate section 20*a* and the centrifugal impellers 21 rotate at the time of gathering operation for gathering assistance. At the time of feeding, the gate section 20*a* stops, and provides the friction force to the gathering space 3 so as not to feed the second and all other notes from the top of the notes 2 stacked in the gathering space 3. At this feeding, the centrifugal impellers 21 rotate in the feeding direction for feeding assistance.

Figure 5A:
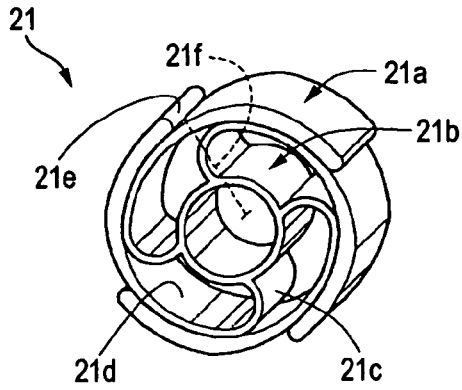
FIGS. 5A and 5B show illustrative views demonstrating the shape and the function of a centrifugal impeller.
Figure 5B:
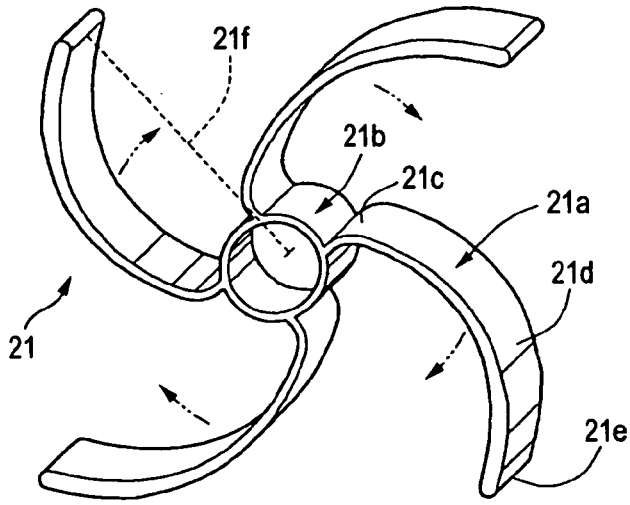

Next, referring to FIGS. 5A and 5B for a diagram illustrating the centrifugal impeller 21, the shape and the function of the centrifugal impeller 21 are described.

FIG. 5A shows a perspective view of the centrifugal impeller 21 when not rotating, and FIG. 5B shows a perspective view of the centrifugal impeller 21 when rotating.

The centrifugal impellers 21 are each formed, as shown in FIG. 5(A), to include four blades 21*a* at regular intervals on the side plane of a tube body 21*b*. The blades 21*a* are formed as a single unit from a rubber material.

The blades 21*a* are so formed that one end of the circular intermediate section 21*d* is connected with a circular base section 21*c* having the smaller radius, and to be inverse-taper gradually increasing in thickness from the base section 21*c* of the tube body 21*b* towards the tip section 21*e*.

When the centrifugal impeller 21 formed as such is rotated in the forward direction (gathering direction), the blades 21*a* spread due to the centrifugal force as shown in (B), lengthening a radius distance 21*f* between the tip section and the rotation axis. At the time of rotation, due to the blades 21*a* formed to be inverse-taper as described in the foregoing, the side of the tip section 21*e* is weighed, and this makes the blades 21*a* easily spread.

Further, when the centrifugal impeller 21 is rotated in the reverse direction (feeding direction), similarly to the case of rotating it in the forward rotation, the blades 21*a* are easily spread.

The structure of the centrifugal impeller 21 allows it to slap the notes 2 with the inside surface of the intermediate section 21*d* or the tip section 21*e* when rotating in the gathering direction as shown by a hypothetical arrow. The slapping force at this time will be strong because the bias force of the rubber material acts in the slapping direction, wanting to be put back to its original shape again.

On the other hand, when rotating in the feeding direction being reverse rotation, the notes 2 are slapped (or softly touched, pushed) by the outer surface of the intermediate section 21*d* or the tip section 21*e*. The slapping force at this time will be weak because the bias force of the rubber material acts in the opposite direction, wanting to be put back to its original shape again.

Figure 6:
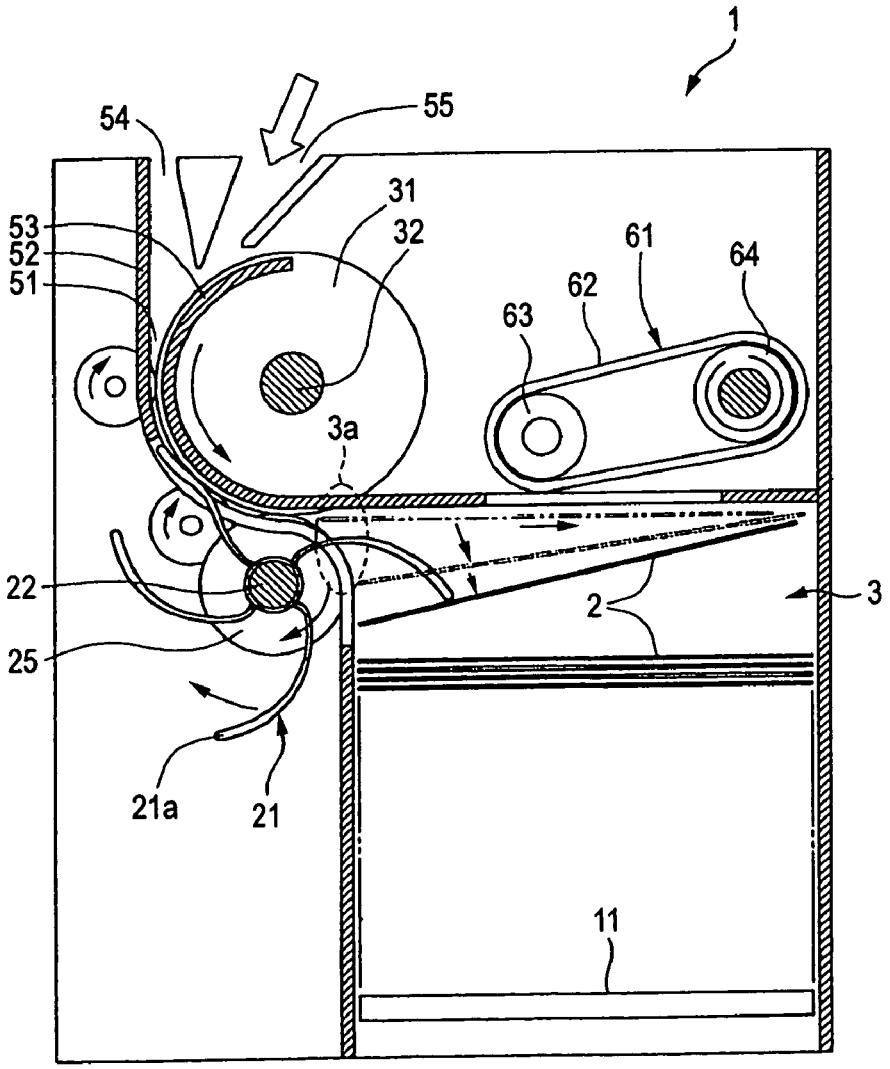
FIG. 6 shows a right side cross sectional view of the paper gathering and feeding device at the time of gathering.
Figure 7:
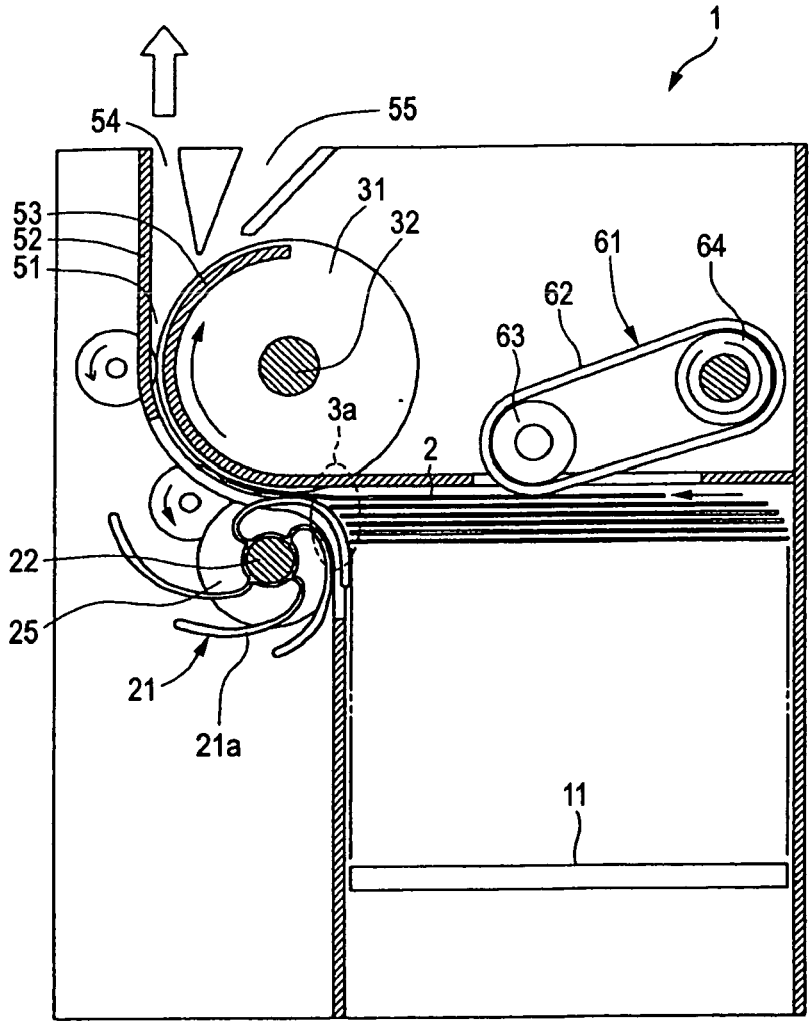
FIG. 7 shows a right side cross sectional view of the paper gathering and feeding device at the time of feeding.

Next, referring to a right side cross sectional view of the paper gathering and feeding device 1 shown in FIG. 6 at the time of gathering, and a right side cross sectional view of the paper gathering and feeding device 1 shown in FIG. 7 at the time of feeding, the effects of the device in the gathering operation and the feeding operation are described.

First of all, referring to FIGS. 6 and 7, on the upper front side, the paper gathering and feeding device 1 is provided with the feed roller 31 described above by referring to FIG. 1, and behind the feed roller 31, provided is a pickup rotation body 61 structured by stretching a belt 62 to pulleys 63 and 64.

The pickup rotation body 61 is structured to be driven by arbitrary driving means, so that it swings in the vertical direction about the pulley 64 locating further back at the time of gathering and feeding operation, and at the time of feeding, touches the gathered notes 2 and feeds the same in the feeding direction.

The transfer path 51 provided for transferring the notes is formed by a guide board 53 guiding the upper, front, and lower parts of the feed roller 31 at positions slightly inner than the peripheral surface thereof and then extending in the horizontal direction toward the rear, and a guide board 52 extending directly downward from a note exit port 54 located front upper end of the paper gathering and feeding device 1 and then partially extending directly downward again after curving along the peripheral surface of the feed roller 31.

Note herein that, to the guide board 52, an adhesive member 29 (not shown) described by referring to FIG. 4 is screwed.

Further, in the vicinity of a coupling section 3*a* between the transfer path 51 and the gathering space 3, the gathering and feeding auxiliary device 20 (that is, the gate section 20*a* and the centrifugal impeller 21) is arranged.

Slightly behind the note exit port 54, provided is a note enter port 55. The note enter port 55 and the note exit port 54 are integrated together inside, and coupled to the transfer path 51.

With such a structure and configuration, operation is observed as below at the time of gathering and at the time of feeding.

At the time of gathering, the notes 2 incoming from the note enter port 55 are transferred inside the transfer path 51 by the transfer force of the feed roller 31, and then exited to the gathering space 3 so as to accumulate those on the up-and-down board 11.

At the time of gathering, as shown in FIG. 6, the blades 21*a* of the centrifugal impeller 21 rotating in synchronization with the feed roller 31 slap down the notes 2, and this prevents the notes 2 to be transferred one after another from clogging caused by collision in the gathering space 3.

At this time, the gate roller 25 rotates together with the centrifugal impeller 21 as a piece with the shaft 22 due to the action of the above-described one-way clutch 23*b*, and the one-way gear 28 becomes free to accept the rotation.

Note herein that, the pickup rotation body 61 is in the up position at this time so as not to prevent the notes 2 from being accumulated.

At the time of feeding, the pickup rotation body 61 is in the down position as shown in FIG. 7 so as to pick up the notes 2 accumulated in a flat manner for sending out thus picked-up note(s) to the transfer path 51.

At this time, the feed roller 31 and the centrifugal impeller 21 are synchronously rotating in the direction reverse to the gathering direction, and the gate roller 25 becomes free from the shaft 22 due to the above-described action of the one-way clutch 23*b*, and being at rest due to the action of the one-way gear 28.

In such a manner, the centrifugal impeller 21 feeds out the notes 2 to the transfer path 51 while softly touching the note 2, thereby assisting the feeding of the notes 2. The gate roller 25 is not rotating, and prevents the second note and other remaining notes 2 from being pulled out by the friction force.

As such, with the simple structure including the centrifugal impeller 21, the gathering/feeding of the notes 2 can be done in a smooth manner. In this manner, clogging of the notes 2 can be prevented, thus improving operation of the device 1.

Figure 8:
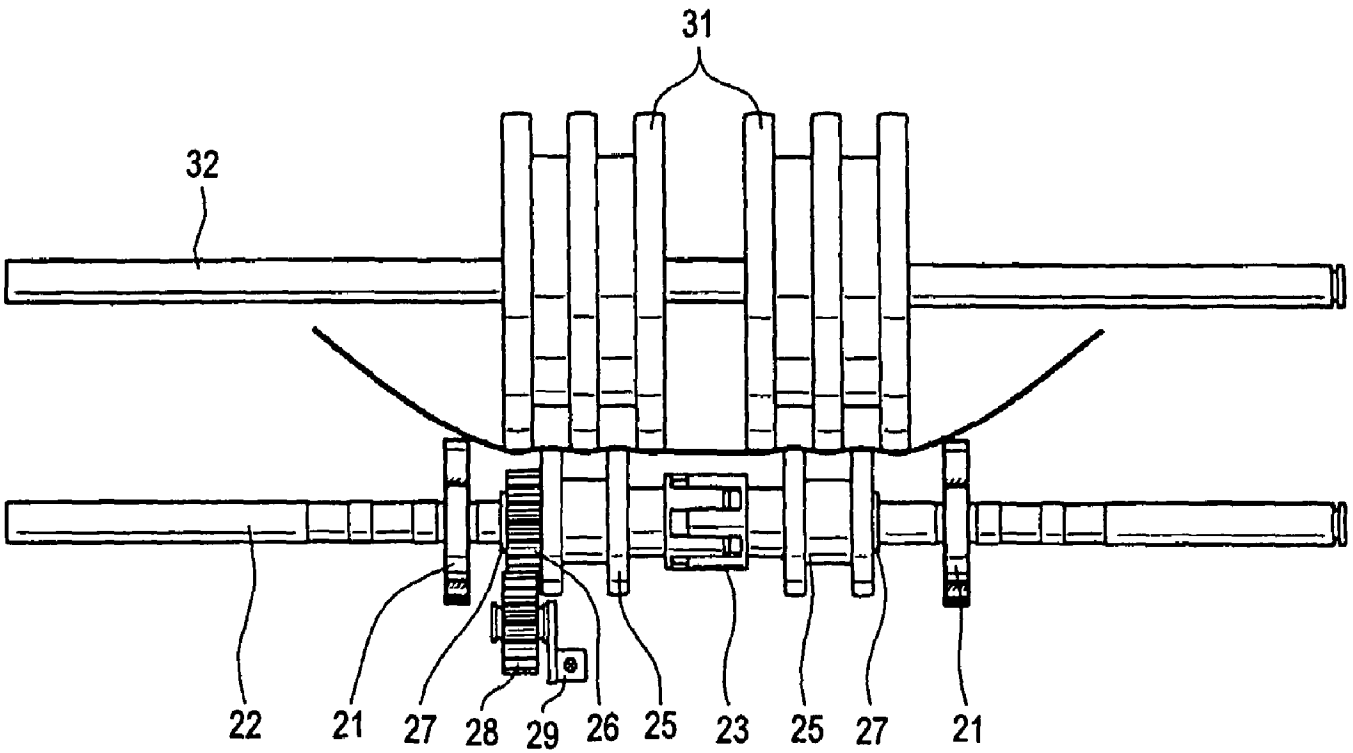
FIG. 8 shows a front view of a gathering and feeding auxiliary device.

Further, as shown in a front view of FIG. 8, the centrifugal impeller 21 is located outside the feed roller 31 and the gate roller 25, and in order to bias the notes 2 upward during the gathering and feeding operations, the notes 2 are extended outwardly (laterally) to effectively extend any bending and folding. In such a manner, clogging caused by old notes sagging between the feed rollers 31 can be effectively prevented.

Figure 9C:
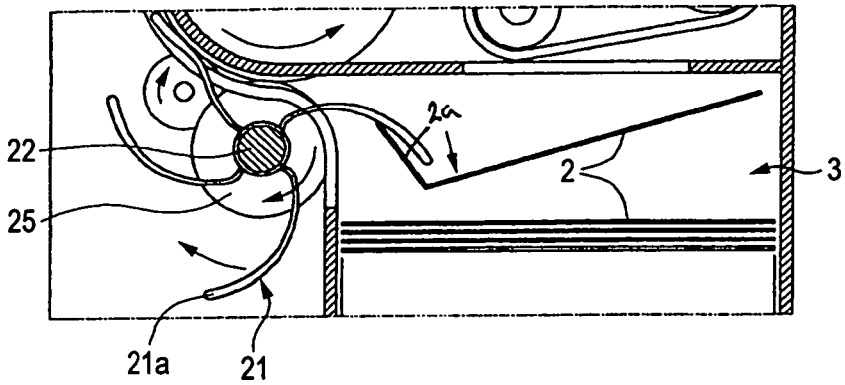
FIGS. 9C and 9D show illustrative views demonstrating the action of a blade with respect to any deformed notes.
Figure 9D:
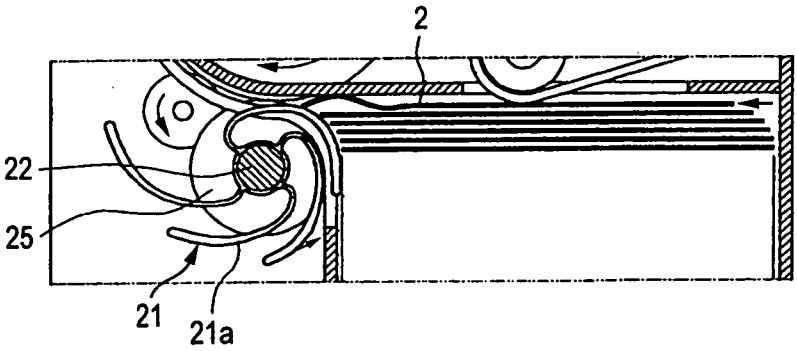
Figure 10:
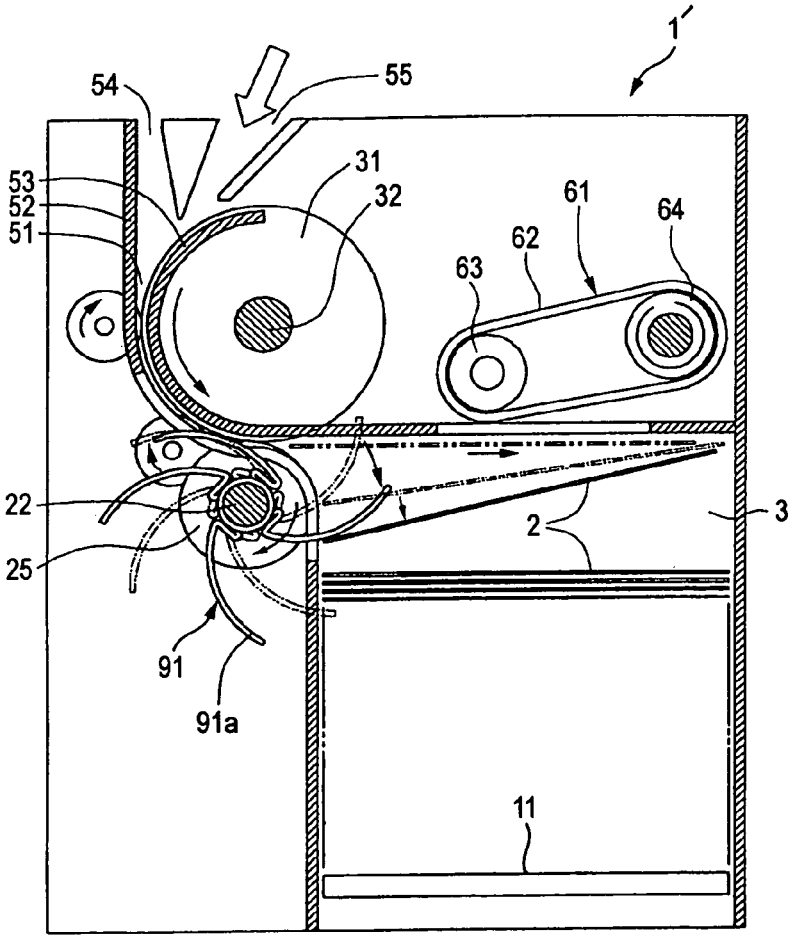
FIG. 10 shows a right side cross sectional view of a conventional paper gathering and feeding device at the time of gathering.
Figure 11:
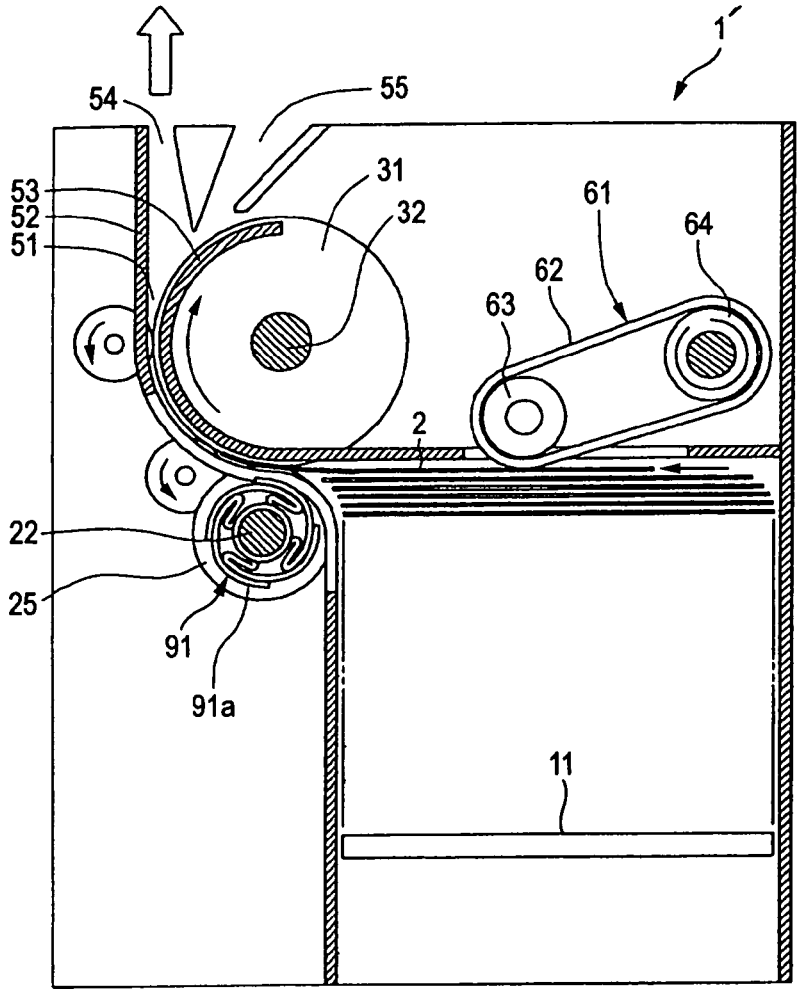
FIG. 11 shows a right side cross sectional view of the conventional paper gathering and feeding device at the time of feeding.

Moreover, as shown in an illustration diagram of FIGS. 9C and 9D, the present invention allows deformed notes to be gathered/fed in a smooth manner. To be more specific, at the time of accumulating the note 2 bent as shown in FIG. 9C, the blades 21*a* can securely perform slapping with an angle narrower than if the blades 21*a* were straight or invertly curved thanks to the shape of the blade 21*a* whose intermediate section 21*d* curves backward with respect to the tip section 21*e*.

The slapping force at this time will be strong enough to deal with the deformed notes because the centrifugal force is added with the elastic force of the blades 21*a*.

With such reasons, as shown in the drawing, at the time of gathering the note 2 whose end 2*a* is bent upward, clogging caused by the next notes 2 abutting to the bent part can be prevented.

At the time of feeding, as shown in FIG. 9D, any deformed notes (notes 2) deformed on the feeding side can be fed in a smooth manner. That is, if the feeding side is deformed as shown, conventionally, the feed roller 31 and the gate roller 25 sandwich the part to make it completely bend, resulting in increase of thickness of about two pieces of notes and thus the overlapped section is too narrow to let the note pass by, resultantly causing clogging. However, by the blades 21*a* transferring the notes 2 in the feeding direction from below with a soft touch, the bent deformed part can be extended for feeding in a straight form.

At this time, the centrifugal impeller 21 is rotating with the same speed as the feeding speed of the notes 2. Therefore, even if no transfer force is derived, no feeding is prevented.

As such, it is possible to widely deal with not only normal notes 2 but also any deformed or bent note 2*a*, without clogging. This can reduce staff required for maintenance. Moreover, even if the centrifugal impeller 21 is deformed in terms of plasticity and thus the blades 21*a* are spreading wider than those when first manufactured, gathering and feeding of the notes 2 is not prevented, thus, the blades 21*a* maintain their gathering and feeding capability over a long period of time.

In the above described exemplary embodiment of the present invention, one centrifugal impeller 21 is provided on each of the right and left sides of the shaft 22. It should be understood, however, that a plurality of centrifugal impellers 21 may be used, so long as the same number of impellers 21 is used on each side of the shaft 22. For example, three impellers 21 may be provided on each side of the shaft.

Further, the number of the blades 21*a* of the centrifugal impeller 21 is not limited to four but may be a single piece.

Alternatively, the shape of the blades 21*a* may be formed straight, rather than curved. If this is the case, the blades 21*a* will slightly sag due to gravity and will spread apart even when not rotating, but such sagging and spreading will not hinder operation of the device 1 because they may rotate during both a gathering and feeding operation.

Moreover, the rubber material forming the centrifugal impeller 21 may be a soft rubber material or a hard rubber material. In consideration of friction, however, the hard rubber material is a preferable option.

Further, the blades 21*a* may be formed by the hard rubber material and may be so formed as to include a hollow inside or a soft section. Such a structure provides the blades 21*a* with friction-resistance and flexibility.

In the correlation between the structure of the present invention and the above-described embodiment, the term "paper" corresponds to the note 2, the term "gathering section" corresponds to the gathering space 3, the term "rotation member" corresponds to the centrifugal impeller 21, the term "changeable piece" corresponds to the blade 21*a*, the term "rotation axis" corresponds to the shaft 22, and the term "transfer section" corresponds to the transfer path 51.

The above description and drawings are only to be considered illustrative of exemplary embodiments, which achieve the features and advantages of the invention. Modification and substitutions to specific process conditions and structures can be made without departing from the spirit and scope of the invention. Accordingly, the invention is not to be considered as being limited by the foregoing description and drawings, but is only limited by the scope of the appended claims.

What is claimed is:

1. A paper gathering and feeding method comprising:

providing a paper gathering and feeding device comprising a rotation member in the vicinity of a coupling section between a transfer section and a gathering section, and wherein said rotation member is provided with a changeable piece having a material such that a radius distance between a tip section and a rotation axis is changeable by centrifugal force produced by rotation of the rotation member;

performing a gathering process for dropping paper to be transferred in the transfer section to gather the same in the gathering section, and performing a feeding process for feeding the paper gathered in the gathering section to the transfer section, wherein at the time of the gathering process, the rotation member rotates in a gathering direction to slap down the paper using the changeable piece with a wider radius distance than a radius of the piece when it is at rest, and at the time of the feeding process, the rotation member rotates in a feeding direction to allow the paper to be fed.

2. A paper gathering and feeding device comprising:

a rotation member which is provided with a changeable piece having a material such that a radius distance between a tip section and a rotation axis is changeable by centrifugal force produced by rotation of the rotation member, and is positioned in the vicinity of a coupling section between a transfer section and a gathering section, wherein the rotation member is constructed as to rotate in a gathering direction to slap down the paper using the changeable piece with a wider radius distance than a radius of the piece when it is at rest, and constructed as to perform a feeding allowance operation to rotate in a feeding direction to allow the paper to be fed.

3. The paper gathering and feeding device according to claim 2, wherein the changeable piece is formed in a curve shape, curving in a rotation backward direction at the time of the slapping-down operation by an intermediate section between the tip section and a base section on a side of the rotation axis.

4. The paper gathering and feeding device according to claim 2, wherein said changeable piece is a centrifugal impeller.

5. The paper gathering and feeding device according to claim 4, wherein said centrifugal impeller comprises flexible blades that are retracted when the impeller is stationary and spread out upon rotation of the impeller.

6. The paper gathering and feeding device according to claim 5, wherein said flexible blades are formed from a rubber material.

7. The paper gathering and feeding device according to claim 2, wherein said changeable piece comprises a curved flexible blade; and wherein the radius distance of said changeable piece is wider when being rotated in the gathering direction than in the feeding direction.

8. The paper gathering and feeding device according to claim 2, wherein said changeable piece comprises a tube body and at least one flexible blade extending from the tube body.

9. The paper gathering and feeding device according to claim 8, wherein said flexible blade is integrally formed.

10. The paper gathering and feeding device according to claim 8, wherein said flexible blade has a curved shape.

11. The paper gathering and feeding device according to claim 10, wherein the flexible blade is biased in a forward direction when the rotation member rotates in the gathering direction.

12. The paper gathering and feeding device according to claim 10, wherein the flexible blade is biased in a reverse direction when the rotation member rotates in the feeding direction.

13. The paper gathering and feeding device according to claim 10, wherein said flexible blade has a base section joined to the tube body, said base section has a smaller radius than the rest of the blade.

14. The paper gathering and feeding device according to of claim 8, wherein the blade has an increased thickness toward the tip section.

15. The paper gathering and feeding device according to claim 8, wherein the blade is inverse-tapered and gradually increases in thickness from a base section toward the tip section.

16. The A rotation member for a paper gathering and feeding device, said rotation member comprising: a changeable piece having a material such that a radius distance between a tip section and a rotation axis is changeable by centrifugal force produced by rotation of the rotation member, said changeable piece being rotatable in a gathering and a feeding direction, wherein said changeable piece comprises a tube body and at least one flexible blade extending from the tube body, wherein a plurality of blades are provided and joined to the tube body in even intervals, said blades wrapping around the tube body and contacting an adjacent blade when the rotation member is in a non-rotation state.

17. A paper gathering and feeding device comprising:

a rotation member which is provided with impeller means for changing a radius distance between a tip section and a rotation axis by centrifugal force produced by rotation of the rotation member, and is positioned in the vicinity of a coupling section between a transfer section and a gathering section, wherein the rotation member is constructed as to rotate in a gathering direction to slap down the paper using the impeller means with a wider radius distance than a radius of the impeller means when it is at rest, and constructed as to perform a feeding allowance operation to rotate in a feeding direction to allow the paper to be fed.

* * * * *